US006929355B2

(12) United States Patent
Matsuzawa

(10) Patent No.: US 6,929,355 B2
(45) Date of Patent: Aug. 16, 2005

(54) INK-JET RECORDING HEAD, MANUFACTURING METHOD OF THE SAME, AND INK-JET RECORDING APPARATUS

(75) Inventor: Akira Matsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 10/386,944

(22) Filed: Mar. 13, 2003

(65) Prior Publication Data

US 2003/0222944 A1 Dec. 4, 2003

(30) Foreign Application Priority Data

Mar. 15, 2002 (JP) ..... 2002-072140

(51) Int. Cl.[7] ..... B41J 2/045
(52) U.S. Cl. ..... 347/71
(58) Field of Search ..... 347/68–72

(56) References Cited

U.S. PATENT DOCUMENTS 6,443,566 B1 * 9/2002 Watanabe et al. ..... 347/68
6,688,731 B1 * 2/2004 Fujii et al. ..... 347/68
6,692,114 B2 * 2/2004 Takahashi ..... 347/70

FOREIGN PATENT DOCUMENTS

| | | |
|---|---|---|
| JP | 05286131 A | 11/1993 |
| JP | 08-058088 | 3/1996 |
| JP | 2001-298219 | 10/2001 |

* cited by examiner

*Primary Examiner*—Stephen Meier
*Assistant Examiner*—An H. Do
(74) *Attorney, Agent, or Firm*—Sughrue Mion, PLLC

(57) ABSTRACT

An ink-jet recording head is provided which possesses a stable ink ejection characteristic obtained by controlling a film thickness of a vibrating plate easily and reliably, a method of manufacturing the same, and an ink-jet recording apparatus. The ink-jet recording head having a passage-forming substrate on which pressure generating chambers communicating with nozzle orifices are defined, and a piezoelectric element composed of a lower electrode, a piezoelectric layer, and an upper electrode, which are provided on the passage-forming substrate while interposing a vibrating plate therebetween. Etching adjustment layers each having etching selectivity with the lower electrode film and the piezoelectric layer, are provided at least between the piezoelectric layer and the lower electrode as well as the vibrating plate in the vicinity of both end portions in the width direction of the piezoelectric element.

10 Claims, 7 Drawing Sheets

INK-JET RECORDING HEAD, MANUFACTURING METHOD OF THE SAME, AND INK-JET RECORDING APPARATUS

BACKGROUND OF THE INVENTION

1. Field of the Invention

The present invention relates to an ink-jet recording head, in which part of a pressure generating chamber communicating with a nozzle orifice for ejecting ink droplets is composed of a vibrating plate and a piezoelectric element is formed on a surface of this vibrating plate so as to cause ejection of ink droplets by displacement of the piezoelectric element, a method of manufacturing the same, and an ink-jet recording apparatus.

2. Description of the Related Art

An ink-jet recording head, in which part of a pressure generating chamber communicating with a nozzle orifice for discharging ink droplets is composed of a vibrating plate, and which causes discharge of ink droplets out of the nozzle orifice by displacing this vibrating plate with a piezoelectric element and thereby pressurizing the ink in the pressure generating chamber, has two types that are already in practical use, namely, one using a piezoelectric actuator of a longitudinal vibration mode which expands and contracts in an axial direction of a piezoelectric element, and one using a piezoelectric actuator of a flexural vibration mode.

The former type effectuates fabrication of a head suitable for high-density printing because the volume of the pressure generating chamber is made variable by allowing an end surface of the piezoelectric element to abut on a vibrating plate. On the other hand, the former type incurs a problem in that the fabrication process is complicated due to the difficult process of cutting the piezoelectric elements into comb-teeth shapes so as to be aligned with an array pitch of the nozzle orifices, and an operation of positioning and fixing the cut piezoelectric elements onto the pressure generating chambers are required.

On the contrary, the latter type effectuates formation of piezoelectric elements on a vibrating plate by a relatively simple process of attaching a green sheet made of a piezoelectric material shaped to the pressure generating chambers and then by baking the green sheet. However, the latter type incurs a problem that high-density arrangement becomes difficult because a certain degree of area is required for utilizing flexural vibration.

Meanwhile, in order to solve the inconvenience of the latter recording head, as shown in Japanese Unexamined Patent Publication No. 5(1993)-286131, a recording head is proposed in which a uniform piezoelectric material layer is formed on an entire surface of a vibrating plate by use of a film-deposition technology, and this piezoelectric material layer is cut into shapes corresponding to the pressure generating chambers by a lithography method to form piezoelectric elements individually for the respective pressure generating chambers.

According to this technology, an operation of attaching piezoelectric elements to a vibrating plate becomes unnecessary. Therefore, the technology provides not only a capability of forming the piezoelectric elements in high density by use of the accurate yet simple technique called the lithography method, but also provides an advantage that high-speed drive can becomes feasible by virtue of reducing the thickness of the piezoelectric elements.

SUMMARY OF THE INVENTION

However, in such an ink-jet recording head, the piezoelectric elements are formed by patterning through etching after lamination of the piezoelectric layer and a upper electrode. Accordingly, there is a problem that film-thicknesses of the vibrating plates become uneven due to errors in etching rates in the thickness direction of the piezoelectric elements.

If the film thicknesses of the vibrating plates, especially the film thicknesses in a region between the piezoelectric elements adjacent to each another become uneven, then variations in amounts of displacement also arise among the respective piezoelectric elements. Accordingly there is a problem that ejection characteristic of the ink to be ejected from respective nozzle orifices is not stabilized.

In consideration of the foregoing circumstances, it is an object of the present invention to provide an ink-jet recording head which possesses a stable ink ejection characteristic being obtained by controlling a film thickness of a vibrating plate easily and reliably, a method of manufacturing the same, and an ink-jet recording apparatus.

To solve the foregoing problems, a first aspect of the present invention is an ink-jet recording head having a passage-forming substrate on which pressure generating chambers communicating with nozzle orifices are defined, and a piezoelectric element composed of a lower electrode, a piezoelectric layer, and an upper electrode, which are provided on the passage-forming substrate while interposing a vibrating plate therebetween. Here, the ink-jet recording head is characterized in that etching adjustment layers each having etching selectivity with the piezoelectric layer and the lower electrode are provided on the piezoelectric element at least on the sides of the vibrating plate of the piezoelectric layer in the vicinity of both end portions in a width direction thereof.

In the first aspect, it is possible to control etching in a thickness direction of the piezoelectric elements by providing etching adjustment layers, thereby making it possible to achieve uniform film thicknesses of the vibrating plates.

A second aspect of the present invention is the ink-jet recording head of the first aspect, which is characterized in that the etching adjustment layer possesses an insulating property.

In the second aspect, a short circuit between the lower electrode and the upper electrode can be prevented with certainty by use of the insulative etching adjustment layer.

A third aspect of the present invention is the ink-jet recording head of the second aspect, which is characterized in that the etching adjustment layer is made of a silicon oxide film or a silicon nitride film.

In the third aspect, it is possible to form the etching adjustment layer easily and with high precision by use of the silicon oxide film or the silicon nitride film.

A fourth aspect of the present invention is the ink-jet recording head of the first aspect, which is characterized in that the etching adjustment layer possesses electric conductivity.

In the fourth aspect, it is possible to eliminate restriction on a region for forming the etching adjustment layer within a region opposed to the piezoelectric element.

A fifth aspect of the present invention is the ink-jet recording head of the fourth aspect, which is characterized in that the etching adjustment layer is made of a metallic material.

In the fifth aspect, it is possible to form the etching adjustment layer of the metallic material easily and in high precision.

A sixth aspect of the present invention is the ink-jet recording head of the fourth or fifth aspect, which is characterized in that the etching adjustment layer is provided on an entire surface in a region corresponding to the piezoelectric element.

In the sixth aspect, high-precision patterning of the etching adjustment layer becomes unnecessary.

A seventh aspect of the present invention is the ink-jet recording head of any of the first to fifth aspects, which is characterized in that the piezoelectric element is gradually broadened from the upper electrode toward the lower electrode and a cross-sectional shape thereof is an approximately trapezoidal shape, and the etching adjustment layer is provided outside a region corresponding to the upper electrode.

In the seventh aspect, it is possible to prevent the etching adjustment layer hindering application of voltage to the piezoelectric element.

An eighth aspect of the present invention is the ink-jet recording head of any of the first to seventh aspects, which is characterized in that a thickness of the etching adjustment layer is equal to or less than a thickness of the piezoelectric layer.

In the eighth aspect, it is possible to form the etching adjustment layer between the piezoelectric layer and the lower electrode easily.

A ninth aspect of the present invention is the ink-jet recording head of any of the first to eighth aspects, which is characterized in that the pressure generating chamber is formed from a silicon single crystal substrate by anisotropic etching, and the respective layers of the piezoelectric element are formed by film-forming and lithography methods.

In the ninth aspect, it is possible to manufacture the ink-jet recording head having high-density nozzle orifices in large quantity and relatively easily.

A tenth aspect of the present invention is an ink-jet recording apparatus, which is characterized by comprising the ink-jet recording head of any of the first to ninth aspects.

In the tenth aspect, it is possible to achieve the ink-jet recording apparatus with improved durability and reliability while preventing destruction of the head.

An eleventh aspect of the present invention is a method of manufacturing an ink-jet recording head, the ink-jet recording head having a passage-forming substrate on which pressure generating chambers communicating with nozzle orifices are defined, and a piezoelectric element composed of a lower electrode, a piezoelectric layer, and an upper electrode being severally made of thin films to be formed on one side of the passage-forming substrate by film-forming and lithography methods while interposing a vibrating plate therebetween. Here, the method is characterized by comprising the steps of: forming the vibrating plate and the lower electrode on the passage-forming substrate; forming an etching adjustment layer having etching selectivity with the piezoelectric layer at least in a region on the lower electrode other than a region where the piezoelectric element is formed; sequentially laminating the piezoelectric layer and the upper electrode and patterning these piezoelectric layer and the upper electrode by etching until reaching at least the etching adjustment layer so as to form the piezoelectric element; and removing the etching adjustment layer in a region other than the piezoelectric element.

In the eleventh aspect, it is possible to suppress an error in an etching rate in a thickness direction of the piezoelectric elements within a thickness of the etching adjustment layer, whereby it is possible to prevent etching of the vibrating plate and the lower electrode.

A twelfth aspect of the present invention is the method of manufacturing an ink-jet recording head of the eleventh aspect, which is characterized in that the etching adjustment layer is etched partially in a thickness direction thereof in the step of forming the piezoelectric element.

In the twelfth aspect, it is possible to suppress an error in the etching rate within the range of the thickness of the etching adjustment layer by etching until reaching the part in the thickness direction of the etching adjustment layer in the step of forming the piezoelectric element. Accordingly, it is possible to prevent etching of the vibrating plate and the lower electrode.

A thirteenth aspect of the present invention is the method of manufacturing an ink-jet recording head of the eleventh or twelfth aspect, which is characterized in that the etching adjustment layer possesses an insulating property.

In the thirteenth aspect, a short circuit between the lower electrode and the upper electrode can be prevented by use of the insulative etching adjustment layer.

A fourteenth aspect of the present invention is the method of manufacturing an ink-jet recording head of the eleventh or twelfth aspect, which is characterized in that the etching adjustment layer possesses electric conductivity.

In the fourteenth aspect, it is possible to eliminate restriction on a region for forming the etching adjustment layer within a region opposed to the piezoelectric element.

A fifteen aspect of the present invention is the method of manufacturing an ink-jet recording head of the fourteenth aspect, which is characterized in that the etching adjustment layer is formed on an entire surface in a region corresponding to the piezoelectric element in the step of forming the etching adjustment layer.

In the fifteenth aspect, high-precision patterning of the etching adjustment layer becomes unnecessary.

BRIEF DESCRIPTION OF THE DRAWINGS

FIGS. 2A and 2B are cross-sectional views of the ink-jet recording head according to Embodiment 1 of the present invention, in which FIG. 2A is a cross-sectional view along a longitudinal direction of a pressure generating chamber and FIG. 2B is a cross-sectional view taken along the A–A' line in FIG. 2A.

FIGS. 6A and 6B are cross-sectional views of an ink-jet recording head according to Embodiment 2 of the present invention, in which FIG. 6A is a cross-sectional view along a longitudinal direction of a pressure generating chamber and FIG. 6B is a cross-sectional view taken along the B–B' line in FIG. 6A.

DETAILED DESCRIPTION OF THE PREFERRED EMBODIMENT

The present invention will be described below in detail based on embodiments.

(Embodiment 1)

Figure 1:
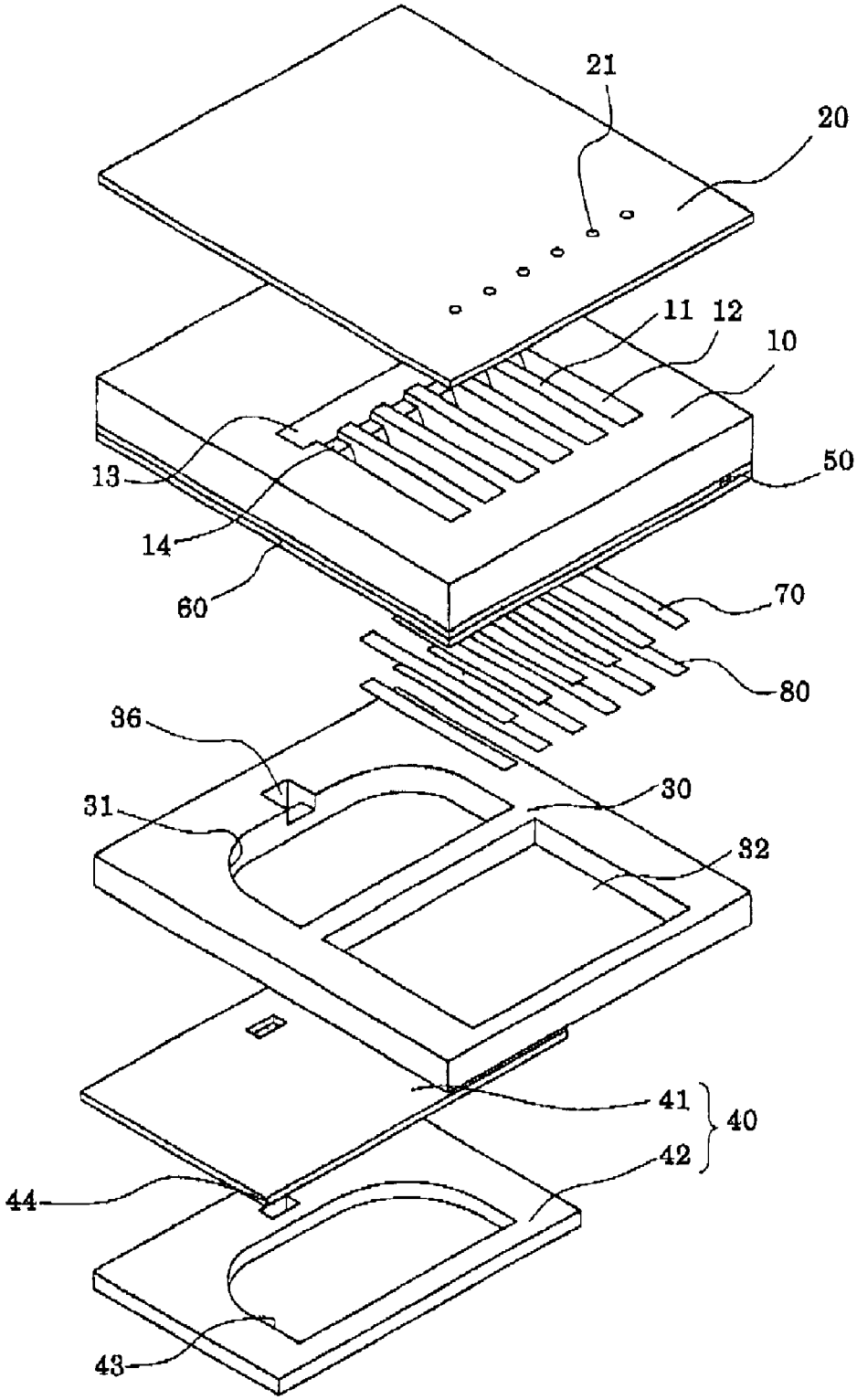
FIG. 1 is an exploded perspective view of an ink-jet recording head according to Embodiment 1 of the present invention.
Figure 2A:
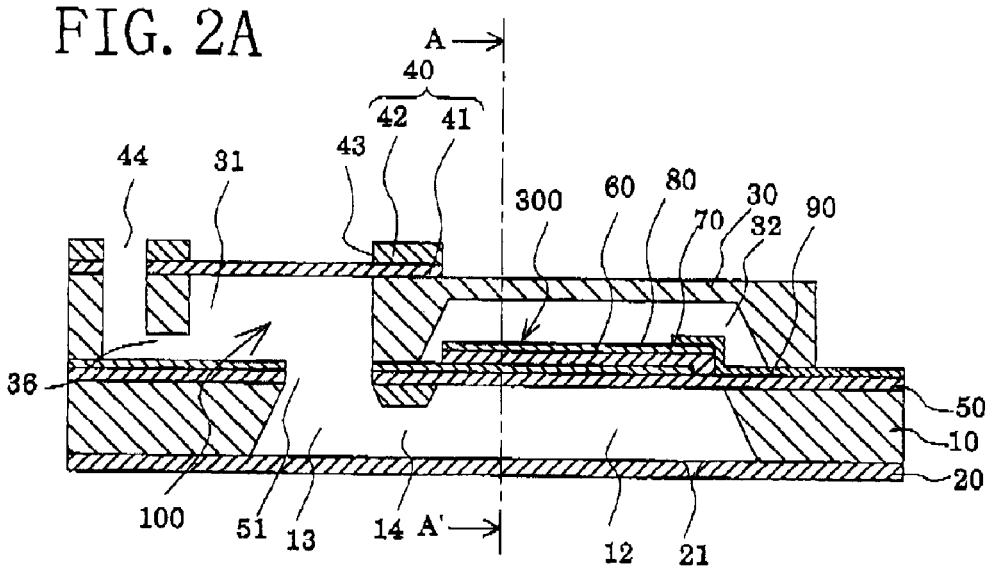
Figure 2B:
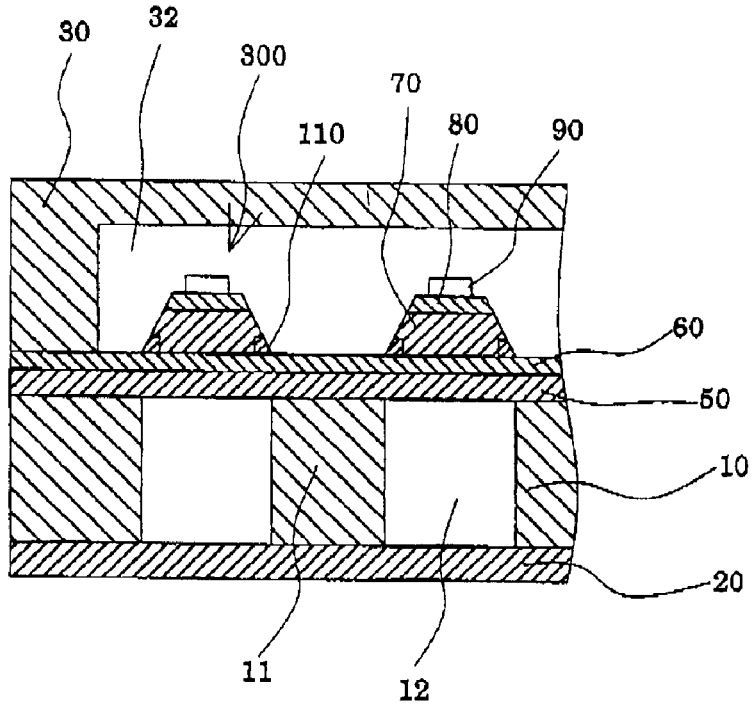

FIG. 1 is an exploded perspective view of an ink-jet recording head according to Embodiment 1 of the present invention. FIGS. 2A and 2B are a cross-sectional view of the ink-jet recording head along the longitudinal direction of a pressure generating chamber and a cross-sectional view taken along the A–A' line thereof.

As illustrated therein, a passage-forming substrate 10 is made of a silicon single crystal substrate having a plane orientation (110) in this embodiment. On one surface thereof, there is formed an elastic film 50 in a thickness of 1 to 2 μm, which is made of silicon dioxide being formed in advance by thermal oxidation.

On this passage-forming substrate 10, pressure generating chambers 12 defined by a plurality of compartment walls are formed by anisotropic etching from the other surface side thereof. Moreover, on the outside of the pressure generating chambers 12 of each row in the longitudinal direction, there is formed a communicating portion 13, which communicates with a reservoir portion 31 to be provided in a reservoir-forming substrate 30, to be described later, through a communicating hole 51 and thereby constitutes a reservoir 100 as a common ink chamber to the respective pressure generating chambers 12. Moreover, this communicating portion 13 communicates with an end portion in the longitudinal direction of each pressure generating chamber 12 severally through an ink supply path 14.

Here, anisotropic etching is performed by use of a difference in etching rates on the silicon single crystal substrate. For example, in this embodiment, anisotropic etching is performed by making use of the following properties. The silicon single crystal substrate is gradually eroded when immersed in an alkaline solution such as KOH, and there develops a first (111) plane being perpendicular to the (110) plane and a second (111) plane forming an angle of about 70 degrees with this first (111) plane and forming an angle of about 35 degrees with the (110) plane, and that the etching rate on the (111) planes is about 1/180 as compared to the etching rate on the (110) plane. By adoption of such anisotropic etching, high-precision processing becomes feasible based on depth processing of a parallelogram shape formed by two first (111) planes and two oblique second (111) planes, whereby it is possible to arrange the pressure generating chambers 12 in high density.

In this embodiment, long edges of each pressure generating chamber 12 are formed of the first (111) planes and short edges thereof are formed of the second (111) planes. This pressure generating chamber 12 is formed by etching until reaching the elastic film 50 so as to almost penetrate the passage-forming substrate 10. Here, the elastic film 50 is hardly eroded at all by the alkaline solution for etching the silicon single crystal substrate. Moreover, each ink supply path 14 which communicates with one end of each pressure generating chamber 12 is formed shallower than the pressure generating chamber 12, and thereby maintains constant flow-passage resistance of the ink flowing into the pressure generating chamber 12. That is, the ink supply path 14 is formed by etching the silicon single crystal substrate halfway in the thickness direction (half-etching). Note that such half-etching is achieved by adjustment of etching time.

With regard to the thickness of such a passage-forming substrate 10, it is preferable that an optimal thickness is selected in accordance with arrangement density of the pressure generating chambers 12. For example, when the arrangement density of the pressure generating chambers 12 is some 180 dots per inch (180 dpi) or thereabout, it is satisfactory if the thickness of the passage-forming substrate 10 is set to about 220 μm. However, in the case of a relatively high-density arrangement such as 200 dpi or higher, for example, the thickness of the passage-forming substrate 10 is preferably set to 100 μm or below. This is due to the reason that it is possible to increase the arrangement density while maintaining rigidity of the partition walls between the adjacent pressure generating chambers 12.

Moreover, a nozzle plate 20, includes nozzle orifices 21 drilled so as to communicate with the respective pressure generating chambers 12 on an opposite side of the ink supply paths 14, is fixed to an opening surface side of the passage-forming substrate 10 with an adhesive or a thermowelding film. Note that the nozzle plate 20 is made of glass ceramics, stainless steel or the like, which has a thickness, for example, from 0.1 to 1 mm, and a coefficient of linear expansion from 2.5 to $4.5\times10^{-6}$/° C. at a temperature of 300° C. or below. The nozzle plate 20 covers one of the surfaces of the passage-forming substrate 10 entirely with one plane thereof, and also functions as a reinforcing plate for protecting the silicon single crystal substrate against shock or external force. Alternatively, the nozzle plate 20 may be formed by use of a material having a coefficient of thermal expansion at almost the same as that of the passage-forming substrate 10. In this case, the degree of deformation of the passage-forming substrate 10 and the nozzle plate 20 with heat become almost equivalent to each other. Accordingly, it is possible to perform joining easily by use of a thermosetting adhesive or the like.

Here, the size of the pressure generating chamber 12 for imparting ink-droplet ejection pressure to ink and the size of the nozzle orifice 21 for ejecting ink droplets are optimized in accordance with an amount of ink droplets to be ejected, an ejection speed, and an ejection frequency. For example, in the case of recording 360 dots of ink droplets per inch, the nozzle orifices 21 need to be formed accurately so as to have diameters of several ten μm.

Meanwhile, a piezoelectric element 300 is constituted having a lower electrode film 60 with a thickness of, for example, about 0.2 μm, a piezoelectric layer 70 with a thickness of, for example, about 0.5 to 5 μm, and an upper electrode film 80 with a thickness of, for example, about 0.1 μm, formed on the elastic film 50 on the opposite side to the opening surface of the passage-forming substrate 10 by lamination in accordance with a process to be described later. Here, the piezoelectric element 300 refers to a portion including the lower electrode film 60, the piezoelectric layer 70, and the upper electrode film 80. In general, the piezoelectric element 300 is constituted by setting one of the electrodes thereof as a common electrode, while patterning the other electrode and the piezoelectric layer 70 on each pressure generating chamber 12. Moreover, a portion composed of one of the electrodes and the piezoelectric layer 70 thus patterned, the portion causing piezoelectric distortion upon application of voltage to the both electrodes, is hereinafter referred to as a piezoelectric active portion. In this embodiment, the lower electrode film 60 is defined as the common electrode of the piezoelectric element 300 and the upper electrode film 80 is defined as an individual electrode of the piezoelectric element 300. However, there is no harm in inverting the above for reasons attributable to drive circuits or wiring designs. In any case, the piezoelectric active portion will be formed on each pressure generating chamber. Furthermore, the piezoelectric element 300, and a vibrating plate to be displaced by the drive of the piezoelectric element 300 are hereinafter collectively referred to as a piezoelectric actuator. Note that the elastic film 50 and the lower electrode film 60 serve as the vibrating plate in the above-described example. However, it is also possible to allow the lower electrode film to serve also as the elastic film.

Moreover, the piezoelectric layer 70 and the lower electrode film 60 of the piezoelectric element 300 of this embodiment are, for example, patterned by etching by use of an ion milling method. Accordingly, the piezoelectric element 300 is gradually broadened from the upper electrode film 80 toward the lower electrode film 60, and is formed such that a cross-sectional shape thereof becomes an approximately trapezoidal shape.

Furthermore, a lead electrode 90 which is made of gold (Au) or the like, for example, is connected to each upper electrode film 80 on each piezoelectric element 300 as described above. This lead electrode 90 is drawn out from the vicinity of an end portion in the longitudinal direction of each piezoelectric element 300 and is severally extended onto the elastic film 50 in the vicinity of an end portion of the passage-forming substrate 10 and then connected to external wiring and the like.

Moreover, etching adjustment layers 110 are provided at least in the vicinity of both end portions in the width direction of the piezoelectric element 300, between the elastic film 50 and the lower electrode film 60, and the piezoelectric layer 70.

In this embodiment, the etching adjustment layers 110 were formed throughout peripheral portions of the piezoelectric element 300.

Although it will be described later in detail, this etching adjustment layer 110 is designed to adjust the etching rates in the thickness direction of the piezoelectric element 300 upon patterning the piezoelectric layer 70 and the upper electrode film 80 by etching so as to achieve uniform thicknesses of the lower electrode film 60 and the elastic film 50 that constitute the vibrating plate, and is made of a material having etching selectivity with the piezoelectric layer 70 and the lower electrode film 60.

Note that the material for the etching adjustment layer 110 is not particularly limited as long as it is the material having etching selectivity with the piezoelectric layer 70 and the lower electrode film 60. For example, an insulative material such as a silicon oxide film or a silicon nitride film, or a conductive material such as a metallic material can be cited.

Furthermore, in the case when an insulative material is used for the etching adjustment layer 110, the etching adjustment layer 110 is formed only in a region which does not affect displacement of the piezoelectric element 300 upon application of voltage to the piezoelectric layer 70 by the lower electrode film 60 and the upper electrode film 80. That is, since the piezoelectric element 300 is formed so as to be broadened toward the lower electrode film 60 to constitute the cross section of the approximately trapezoidal shape, the etching adjustment layer 110 is preferably provided outside a region opposing the upper electrode film 80.

By provision of the etching adjustment layer 110 having etching selectivity with the piezoelectric layer 70 and the lower electrode film 60 as described above, a film thickness of the elastic film 50 and a film thickness of the lower electrode film 60 together as the vibrating plate, especially the film thicknesses of the elastic film 50 and the lower electrode film 60 between the piezoelectric elements 300 adjacent to each other, are made uniform. In this way, an amount of displacement of the piezoelectric element 300 is made uniform and it is thereby possible to stabilize the ejection characteristics of the ink to be ejected from the respective nozzle orifices 21.

Moreover, a piezoelectric element holding portion 32 is provided in a region opposed to the piezoelectric elements 300 of the reservoir-forming substrate 30 to secure a space to an extent to which the movement of the piezoelectric elements 300 is not interfered with.

As for the above-described reservoir-forming substrate 30, it is preferable to use a material having approximately the same coefficient of thermal expansion as that of the passage-forming substrate 10, such as glass, a ceramic material or the like, for example. In this embodiment, it is formed by use of a silicon single crystal substrate, which is the same material as the passage-forming substrate 10.

Moreover, a compliance substrate 40 composed of a sealing film 41 and a fixing plate 42 is joined onto the above-described reservoir-forming substrate 30. Here, the sealing film 41 is made of a material having low rigidity and having flexibility (such as a polyphenylene sulfide (PPS) film in a thickness of 6 $\mu$m). One side of the reservoir portion 31 is sealed by this sealing film 41. Meanwhile, the fixing plate 42 is made of a hard material of metal or the like (such as stainless steel (SUS) in a thickness of 30 $\mu$m). A region of the fixing plate 42 opposed to the reservoir 100 is completely removed in the thickness direction so as to constitute an opening portion 43. Accordingly, one side of the reservoir 100 is sealed only by the sealing film 41 having flexibility.

Moreover, on the compliance substrate 40 outside of an approximately center portion in the longitudinal direction of this reservoir 100, there is formed an ink introducing port 44 for supplying the ink to the reservoir 100. Furthermore, on the reservoir-forming substrate 30, there is provided an ink introducing path 36 communicating the ink introducing port 44 with a sidewall of the reservoir 100.

In the above-described ink-jet recording head of this embodiment, the ink is taken in from the ink introducing port 44 connected to an unillustrated external ink supplying means, whereby the ink is filled throughout the inside from the reservoir 100 to the nozzle orifices 21. Thereafter, voltage is applied between the lower electrode film 60 and the upper electrode film 80 corresponding to each pressure generating chamber 12 in accordance with a recording signal from a driver circuit, whereby the elastic film 50, the lower electrode film 60, and the piezoelectric layer 70 are subjected to flexural deformation. Accordingly, pressure inside each of the pressure generating chambers 12 is increased and the ink droplets are thereby ejected from the nozzle orifice 21.

Although a method of manufacturing the above-described ink-jet recording head of this embodiment is not particularly limited, one example thereof will be described with reference to FIG. 3 to FIG. 5. Note that FIG. 3 to FIG. 5 are cross-sectional views of substantial parts shown in a direction of parallel arrangement of the pressure generating chambers 12 of the ink-jet recording head.

Figure 3A:
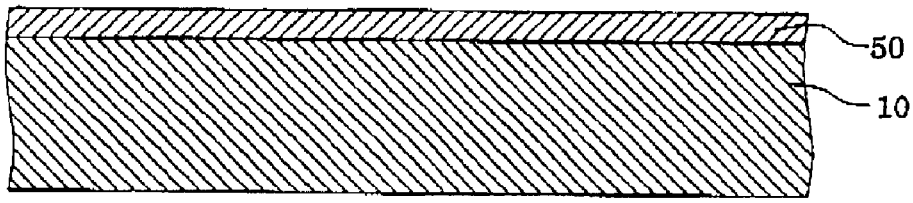
FIGS. 3(A), 3(B) and 3(C) are cross-sectional views showing a manufacturing process for the ink-jet recording head according to Embodiment 1, which is taken along a direction of parallel arrangement of pressure generating chambers.

First, as shown in FIG. 3A, a wafer of a silicon single crystal substrate to be formed into the passage-forming substrate 10 is subjected to thermal oxidation in a diffusion furnace at a temperature of about 1100° C., thus forming the elastic film 50 made of silicon dioxide.

Figure 3B:
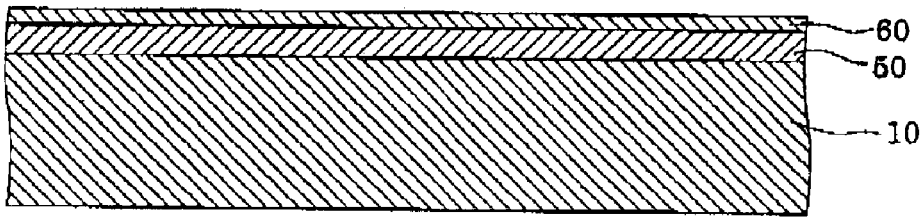

Next, as shown in FIG. 3B, the lower electrode film 60 is formed on the entire surface of the elastic film 50 by a sputtering method, and then the lower electrode film 60 is patterned to form an entire pattern. Platinum (Pt) or the like is suitable for the material of this lower electrode film 60. This is because the after-mentioned piezoelectric layer 70 to be formed into a film by a sputtering method or a sol-gel method needs to be baked then crystallized at a temperature from about 600° C. to 1000° C. under an atmosphere of air or oxygen after film-forming. That is, the material for the lower electrode film 60 must retain electric conductivity at such a high temperature and under an oxidation atmosphere. In particular, when lead zirconate titanate (PZT) is used as the piezoelectric layer 70, it is preferable that the variation of electric conductivity attributable to diffusion of lead oxide is small. Platinum is preferred due to these reasons.

Figure 3C:
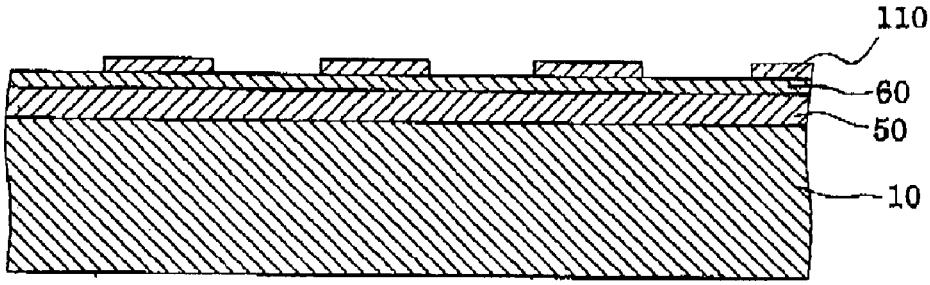

Next, as shown in FIG. 3C, the etching adjustment layer 110 is formed and patterned on the lower electrode film 60.

This etching adjustment layer 110 is designed to suppress an error in etching rates within a range of the thickness of the etching adjustment layer 110 by allowing etching in the thickness direction of the piezoelectric element 300 to reach the etching adjustment layer 110 and to be done partially in the thickness direction. For this reason, it is satisfactory if the etching adjustment layer 110 is formed at least in a region other than the piezoelectric element 300. In this embodiment, the etching adjustment layer 110 is formed on the elastic film 50 and the lower electrode film 60 in a region other than where the upper electrode film 80 is formed in a subsequent step.

Moreover, the error in etching rates in the thickness direction of the piezoelectric element 300 is generally 3% or greater in the event of etching the piezoelectric layer 70 and the upper electrode film 80 to perform patterning of the piezoelectric element 300. Accordingly, it is preferable that the etching adjustment layer 110 is adjusted so that the error in the etching rates is suppressed within the range of the thickness of the etching adjustment layer 110.

Note that the thickness of the etching adjustment layer 110 may be set equal to or less than the thickness of the piezoelectric layer 70, whereby it is possible to form the etching adjustment layer 110 easily and to perform patterning of the piezoelectric element 300 easily in the subsequent step.

Figure 4A:
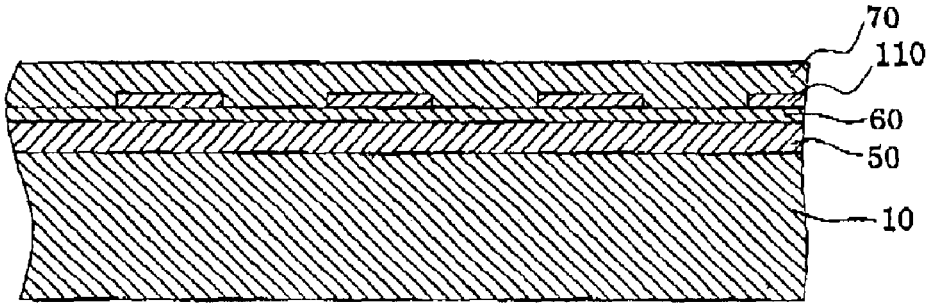
FIGS. 4(A), 4(B) and 4(C) are cross-sectional views showing the manufacturing process for the ink-jet recording head according to Embodiment 1, which is taken along the direction of parallel arrangement of the pressure generating chambers.

Next, the piezoelectric layer 70 is formed into a film as shown in FIG. 4A. It is preferable that the crystal of this piezoelectric layer 70 is oriented. For example, in this embodiment, the piezoelectric layer 70 having the oriented crystal is formed by use of a so-called sol-gel method, which includes the steps of applying and drying so-called sol composed of catalyst in which organic metal is dissolved and dispersed to form gel, and baking at a high temperature to obtain the piezoelectric layer 70 made of metal oxide. As the material for the piezoelectric layer 70, a material in a lead zirconate titanate group is preferred for use in an ink-jet recording head. Note that the method of film-forming for this piezoelectric film 70 is not particularly limited and the piezoelectric film 70 may be formed, for example, by a sputtering method.

In addition, it is also possible to use a method including the steps of forming a lead zirconate titanate precursor film by a sol-gel method, a sputtering method or the like, and forming crystal at a low temperature by a high pressure process in an alkaline aqueous solution.

In any case, the piezoelectric film 70 thus formed has the crystal subjected to priority orientation unlike a bulk piezoelectric material. Moreover, in this embodiment, the piezoelectric layer 70 has the crystal formed into a columnar shape. Note that the priority orientation refers to a state where the direction of orientation of the crystal is not in disorder but a specific crystal plane of the crystal is oriented approximately to a fixed direction. In addition, a thin film having a crystal in a columnar shape refers to a state of forming a thin film, in which crystals having approximately columnar shapes are gathered across the surface direction while center axes thereof are coincided approximately with the thickness direction. It is a matter of course that the piezoelectric film 70 maybe a thin film formed of particle-shaped crystals subjected to the priority orientation. Note that the thickness of the piezoelectric film thus manufactured in the thin film step is generally from 0.2 to 5 $\mu$m.

Figure 4B:
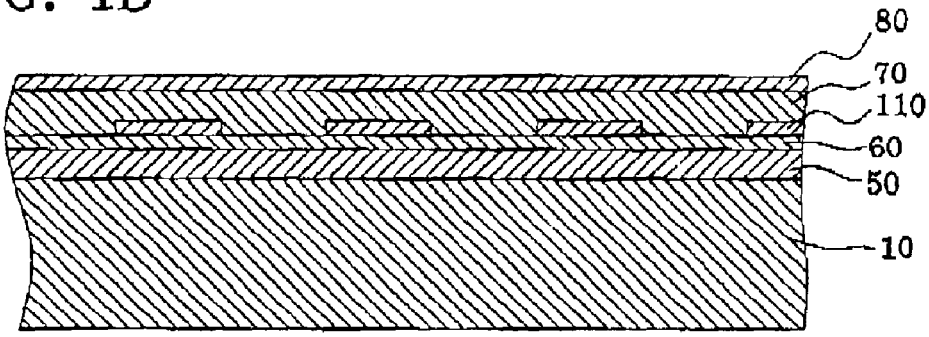

Next, the upper electrode film 80 is formed into a film as shown in FIG. 4B. It is essential only that the upper electrode film 80 is made of a highly conductive material; therefore, many kinds of metal such as aluminum, gold, nickel and platinum, conductive oxides, and the like can be used. In this embodiment, platinum is formed into a film by sputtering.

Figure 4C:
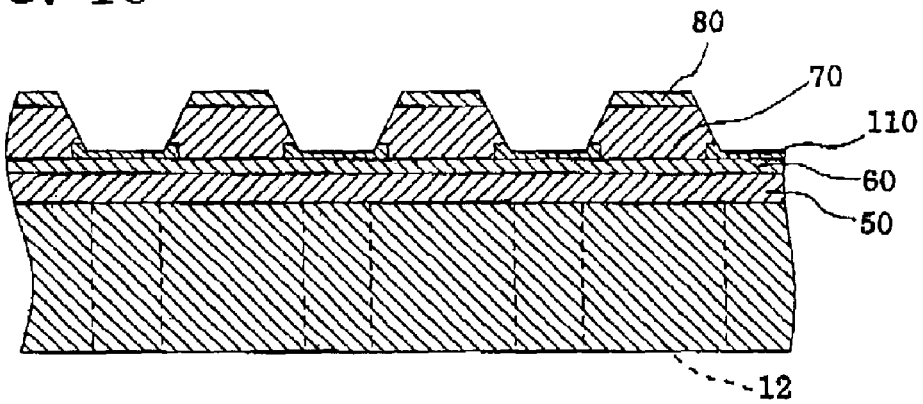

Next, as shown in FIG. 4C, patterning of the piezoelectric elements 300 is performed by etching the piezoelectric layer 70 and the upper electrode film 80 until reaching at least the etching adjustment layer 110.

In this etching, since the etching adjustment layer 110 is provided above the elastic film 50 and the lower electrode film 60, the error in the etching rates in the thickness direction of the piezoelectric element 300 can be suppressed within the thickness of the etching adjustment layer 110. That is, the lower electrode film 60 and the elastic film 50 are not subjected to etching.

Figure 5A:
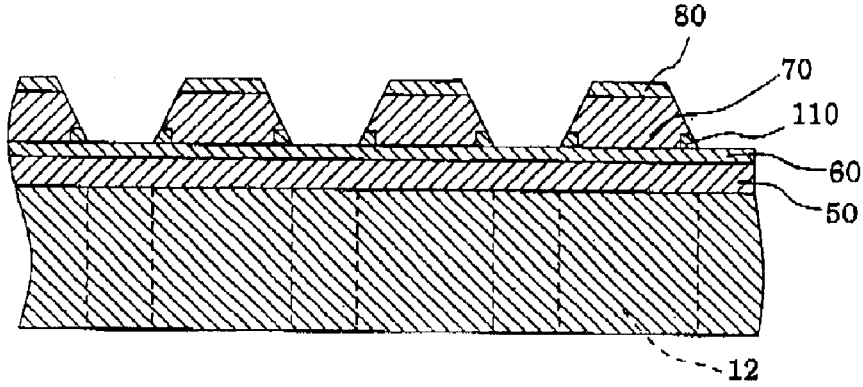
FIGS. 5(A), 5(B) and 5(C) are cross-sectional views showing the manufacturing process for the ink-jet recording head according to Embodiment 1, which is taken along the direction of parallel arrangement of the pressure generating chambers.

Next, as shown in FIG. 5A, the etching adjustment layer 100 other than that in a region of the piezoelectric layer 300, that is, the etching adjustment layer 110 other than that in a region between the elastic film 50 and the lower electrode film 60, and the piezoelectric layer 70, is removed.

The region of the etching adjustment layer 110 to be removed herein refers to the region where the error in the etching rates is suppressed within the thickness of the etching adjustment layer 110 in the event of forming the piezoelectric element 300 by patterning. Accordingly, it is possible to uniformly form the film thicknesses of the elastic film 50 and the lower electrode film 60 by removing this region. Note that the etching adjustment layer 110 is formed of the material having etching selectivity with the piezoelectric layer 70 and the lower electrode film 60. Accordingly, it is possible to easily remove the etching adjustment layer 110 only in the region other than the piezoelectric element 300.

Moreover, removal of the etching adjustment layer 110 in the region other than the piezoelectric element 300 can be performed by wet etching, or dry etching such as oxygen or fluorine plasma etching, for example, any of which does not etch the piezoelectric element 300.

As described above, the film thicknesses of the elastic film 50 and the lower electrode film 60 together as the vibrating plate, and especially the film thicknesses of the elastic film 50 and the lower electrode film 60 between the piezoelectric elements 300 adjacent to each other can be uniformly formed. Accordingly, it is possible to render the amount of displacement of the piezoelectric element 300 uniform, and it is thereby possible to stabilize the ejection characteristics of the ink to be ejected from the respective nozzle orifices 21.

Figure 5B:
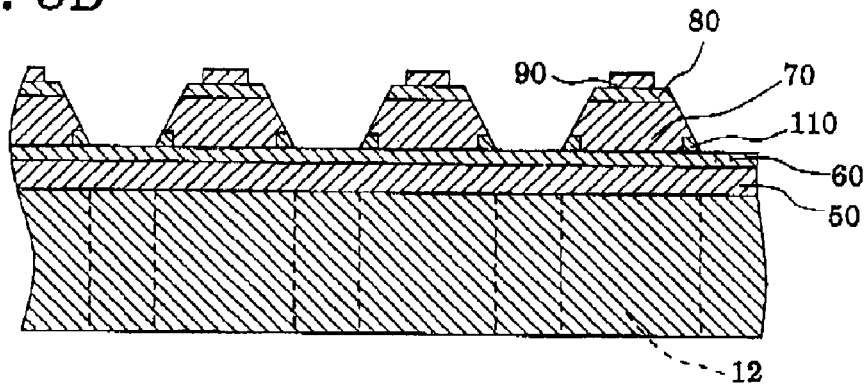

Next, the lead electrodes 90 are formed as shown in FIG. 5B. To be more precise, the lead electrodes 90 made of gold (Au) or the like, for example, are formed across the entire surface of the passage-forming substrate 10 and patterned in line with the respective piezoelectric elements 300.

Figure 5C:
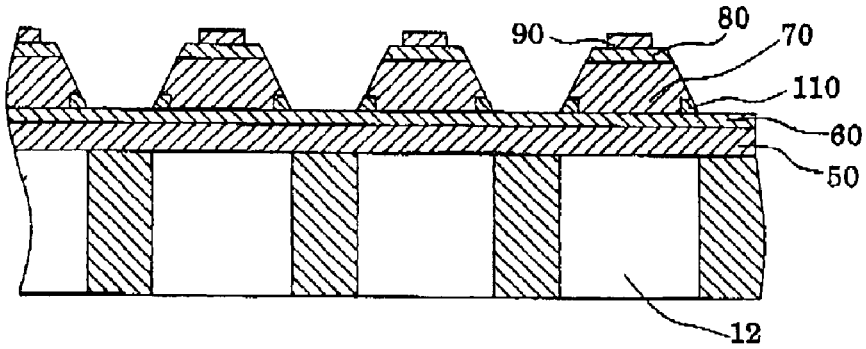

Description has been made above regarding the film-forming process. After forming the films as described above, the silicon single crystal substrate is subjected to anisotropic etching with the alkaline aqueous solution as described previously, and then the pressure generating chambers 12, the unillustrated communicating portion 13 and the ink supply paths 14, and the like are formed as shown in FIG. 5C.

Thereafter, the reservoir-forming substrate 30 and the compliance substrate 40 are joined to the passage-forming substrate 10, and the nozzle plate 20 having the nozzle orifices 21 drilled thereon is joined to the surface on the opposite side to the reservoir-forming substrate 30, whereby the ink-jet recording head of this embodiment is formed.

Moreover, as a matter of fact, many chips are formed simultaneously on one wafer by the above-described series of film-forming process and anisotropic etching. After completion of the process, the wafer is divided into the passage-forming substrates 10 of the same chip size as shown in FIG. 1. Thereafter, the reservoir-forming substrate 30 and the compliance substrate 40 are sequentially adhered to the divided passage-forming substrate 10 for integration, and the ink-jet recording is thereby finished.

(Embodiment 2)

Figure 6A:
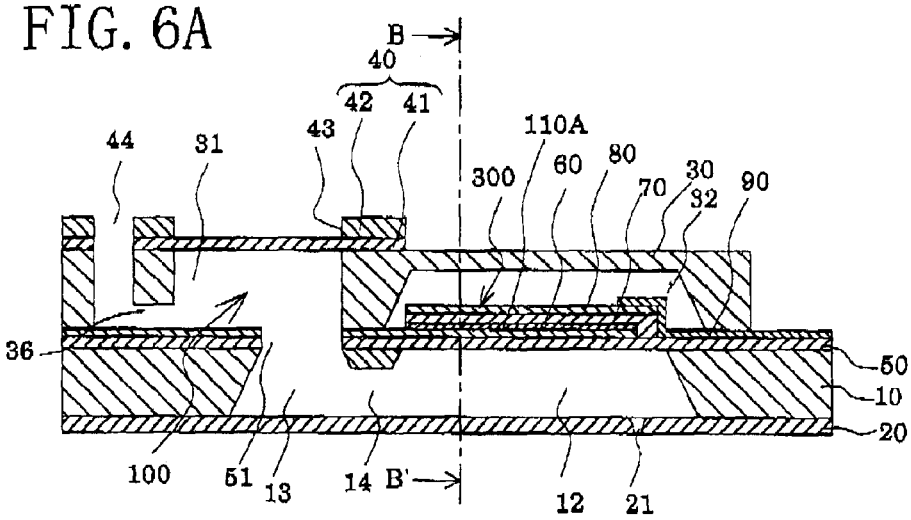
Figure 6B:
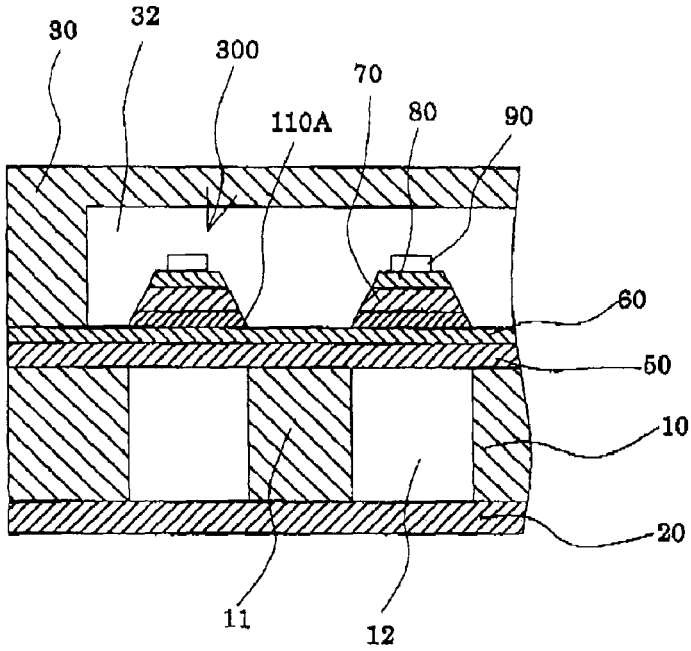

FIGS. 6A and 6B are a cross-sectional view of an ink-jet recording head according to Embodiment 2 along the longitudinal direction of a pressure generating chamber and a cross-sectional view taken along the B–B' line thereof.

As shown in FIG. 6, the ink-jet recording head of Embodiment 2 is similar to the above-described Embodiment 1, except that an etching adjustment layer 110A is formed on an entire surface between the lower electrode film 60 and the piezoelectric layer 70 of the piezoelectric element 300 being opposed by the piezoelectric element 300.

In such an etching adjustment layer 110A, in order to enable the piezoelectric layer 70 to be displaced by applying voltage between the lower electrode film 60 and the upper electrode film 80 of the piezoelectric element 300, the etching adjustment layer 110A needs to be formed of a conductive material such as a metallic material.

Note that it is preferable to set the thickness of the etching adjustment layer 110A equal to or less than the thickness of the piezoelectric layer 70 even in the case of this embodiment where the conductive material is used for the etching adjustment layer 110A and is provided on the entire surface in the region opposed by the piezoelectric element 300, in order to facilitate removal of etching adjustment layer 110A in the region other than the piezoelectric element 300 and to effectuate patterning of the piezoelectric element 300.

Moreover, by setting the thickness of the etching adjustment layer 110A equal to or less than the thickness of the piezoelectric layer 70, it is possible to prevent significant deterioration of the ink ejection characteristic because of an influence to displacement of the piezoelectric element 300.

Even when such a constitution is adopted, as similar to the above-described Embodiment 1, the film thicknesses of the elastic film 50 and the lower electrode film 60 together as the vibrating plate, especially the film thicknesses of the elastic film 50 and the lower electrode film 60 between the piezoelectric elements 300 adjacent to each other can be easily and reliably formed into uniform film thicknesses. In this way, the amount of displacement of the piezoelectric element 300 is made uniform and it is thereby possible to stabilize the ejection characteristics of the ink to be ejected from the respective nozzle orifices 21.

Moreover, high-precision patterning upon formation of the etching adjustment layer becomes unnecessary by forming the etching adjustment layer 110A on the entire surface in the region opposed by the piezoelectric element 300, and the manufacturing process can be thereby simplified.

(Other Embodiments)

Although Embodiment 1 and Embodiment 2 of the present invention have been described above, the fundamental constitution of the ink-jet recording head shall not be limited to those expressly stated above.

Figure 7:
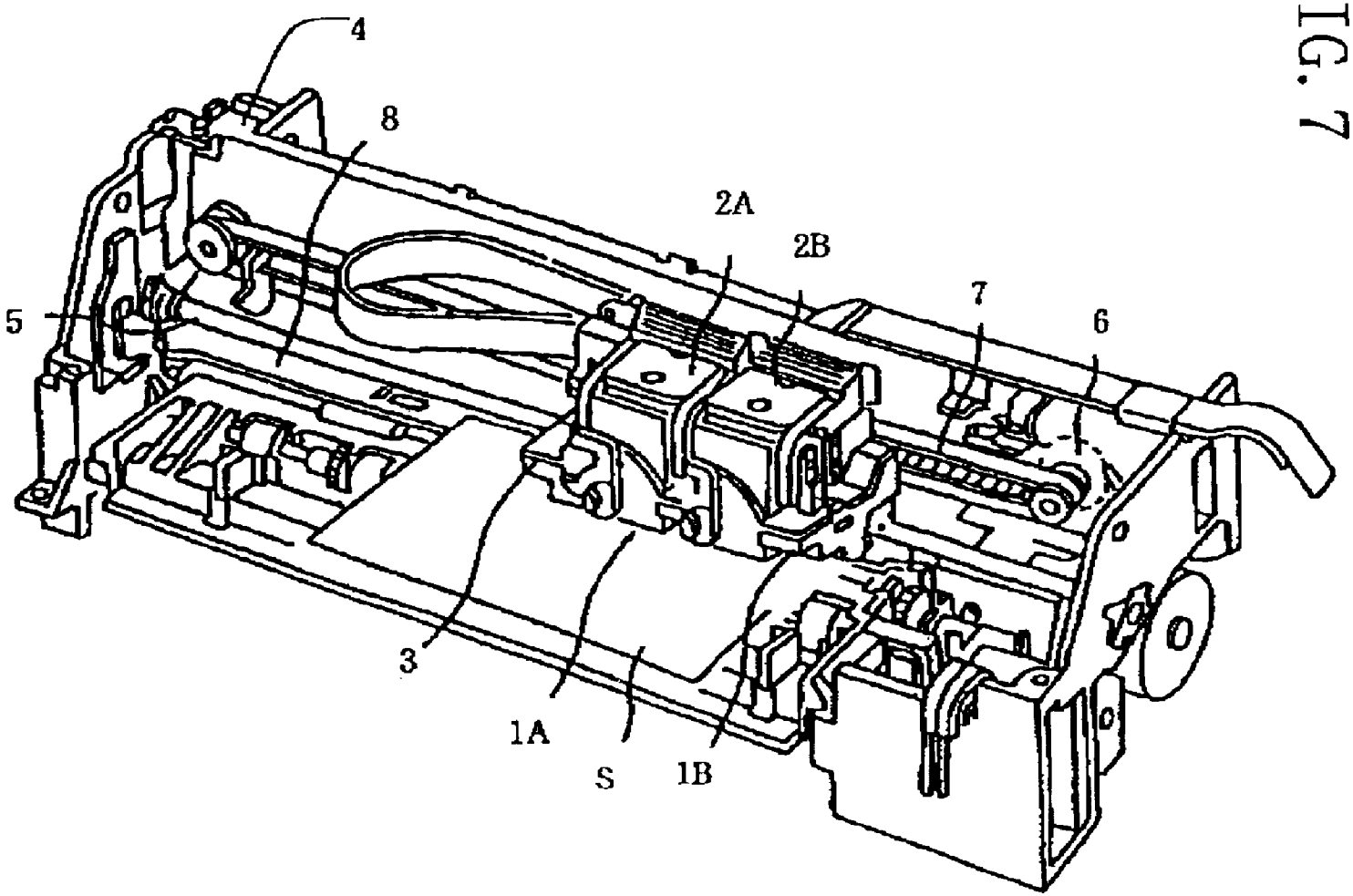
FIG. 7 is a schematic illustration of an ink-jet recording apparatus according to one embodiment of the present invention.

The ink-jet recording head of each of these embodiments constitutes part of a recording head unit provided with an ink-flow path that communicates with an ink cartridge and the like, and the recording head unit is mounted onto an ink-jet recording apparatus. FIG. 7 is a schematic illustration showing one example of the ink-jet recording apparatus.

As shown in FIG. 7, cartridges 2A and 2B which constitute a ink supply means are detachably provided on recording head units 1A and 1B which include the ink-jet recording heads. A carriage 3 loading these recording head units 1A and 1B is disposed so as to be movable in an axial direction on a carriage shaft 5 fitted to an apparatus body 4. These recording head units 1A and 1B are designed to severally eject, for example, a black ink composition and a color ink composition.

Moreover, driving force of a drive motor 6 is transmitted to the carriage 3 via an unillustrated plurality of gears and a timing belt 7, whereby the carriage 3 mounting the recording head units 1A and 1B is allowed to move along the carriage shaft 5. Meanwhile, a platen 8 is provided on the apparatus body 4 along the carriage shaft 5, and a recording sheet S being a recording medium such as paper fed by an unillustrated feeding roller or the like is conveyed on the platen 8.

As described above, according to the present invention, by provision of an etching adjustment layer, an error in etching rate in a thickness direction of a piezoelectric element can be suppressed within a range of a thickness of the etching adjustment layer in the formation of the piezoelectric element by etching, and then by removing the etching adjustment layer, film thicknesses of a vibrating plate and a lower electrode, especially the film thicknesses of the vibrating plate and the lower electrode between the respective piezoelectric elements can be formed uniformly. In this way, an amount of displacement of the piezoelectric element can be made uniform, and it is thereby possible to stabilize ejection characteristics of ink to be ejected from respective nozzle orifices.

What is claimed is:

1. An ink-jet recording head comprising:

a passage-forming substrate on which pressure generating chambers communicating with nozzle orifices are defined, and a piezoelectric element composed of a lower electrode, a piezoelectric layer, and an upper electrode, which are provided on the passage-forming substrate while interposing a vibrating plate therebetween, wherein, etching adjustment layers are provided in a region other than the piezoelectric element, where said etching adjustment layers have etching selectivity with the piezoelectric layer and the lower electrode so that the lower electrode is not etched when the piezoelectric layer is etched as well as when a region other than the piezoelectric element is removed, and wherein said etching adjustment layers remain at least on both end portions of the piezoelectric element in a width direction thereof between the piezoelectric layer and the lower electrode constituting the vibration plate when the region other than the piezoelectric element is removed.

2. The ink-jet recording head according to claim 1, wherein, the etching adjustment layer possesses an insulating property.

3. The ink-jet recording head according to claim 2 wherein the etching adjustment layer is made of either one of a silicon oxide film and a silicon nitride film.

4. The ink-jet recording head according to claim 1, wherein, the etching adjustment layer possesses electric conductivity.

5. The ink-jet recording head according to claim 4, wherein, the etching adjustment layer is made of a metallic material.

6. The ink-jet recording head according to claim 4, wherein, the etching adjustment layer is provided on an entire surface in a region corresponding to the piezoelectric element.

7. The ink-jet recording head according to claim 1, wherein the piezoelectric element is gradually broadened from the upper electrode toward the lower electrode and a cross-sectional shape thereof is an approximately trapezoidal shape, and the etching adjustment layer is provided outside a region corresponding to the upper electrode.

8. The ink-jet recording head according to claim 1, wherein a thickness of the etching adjustment layer is no more than a thickness of the piezoelectric layer.

9. The ink-jet recording head according to claim 1, wherein, the pressure generating chamber is formed from a silicon single crystal substrate by anisotropic etching, and the respective layers of the piezoelectric element are formed by film-deposition technology and lithography methods.

10. An ink-jet recording apparatus comprising:

an ink-jet recording head according to any of claims 1 to 9.

* * * * *